US008164014B2

(12) United States Patent
Tatehata et al.

(10) Patent No.: US 8,164,014 B2
(45) Date of Patent: Apr. 24, 2012

(54) LIGHT GUIDING SHEET AND MOVABLE CONTACT BODY USING THE SAME

(75) Inventors: Naoki Tatehata, Kyoto (JP); Tsutomu Aisaka, Osaka (JP); Hirotoshi Watanabe, Osaka (JP); Yousuke Chikahisa, Hyogo (JP)

(73) Assignee: Panasonic Corporation, Osaka (JP)

( * ) Notice: Subject to any disclaimer, the term of this patent is extended or adjusted under 35 U.S.C. 154(b) by 314 days.

(21) Appl. No.: 12/628,702

(22) Filed: Dec. 1, 2009

(65) Prior Publication Data

US 2010/0140069 A1 Jun. 10, 2010

(30) Foreign Application Priority Data

Dec. 4, 2008 (JP) ..... 2008-309387

(51) Int. Cl.
*H01H 9/18* (2006.01)
*H01H 13/83* (2006.01)

(52) U.S. Cl. ..... 200/310; 200/313; 200/314; 200/317

(58) Field of Classification Search ..... 341/22; 345/168–170; 200/5 A, 512, 517, 310–317
See application file for complete search history.

(56) References Cited

U.S. PATENT DOCUMENTS

| | | | | |
|---|---|---|---|---|
| 6,373,008 | B1 * | 4/2002 | Saito et al. | 200/310 |
| 6,603,085 | B2 * | 8/2003 | Oya et al. | 200/512 |
| 7,271,360 | B2 * | 9/2007 | Kobayashi | 200/314 |
| 7,399,937 | B2 * | 7/2008 | Nishimura | 200/314 |
| 7,423,229 | B2 * | 9/2008 | Chen | 200/314 |
| 7,888,613 | B2 * | 2/2011 | Jeffery et al. | 200/314 |
| 7,897,889 | B2 * | 3/2011 | Chikahisa et al. | 200/314 |
| 7,960,663 | B2 * | 6/2011 | Yoshihiro | 200/310 |
| 7,994,445 | B2 * | 8/2011 | Aihara et al. | 200/314 |
| 2007/0199811 | A1 * | 8/2007 | Hotta et al. | 200/310 |
| 2008/0247191 | A1 * | 10/2008 | Hsu | 362/612 |
| 2009/0179870 | A1 * | 7/2009 | Scholz et al. | 345/174 |

FOREIGN PATENT DOCUMENTS

JP 2007-087749 A 4/2007

* cited by examiner

*Primary Examiner* — Michael Friedhofer
(74) *Attorney, Agent, or Firm* — Panasonic Patent Center; Dhiren Odedra; Kerry Culpepper

(57) ABSTRACT

A concavo-convex light emitting section provided on an under surface of a base material is formed of a synthetic resin with inorganic oxide dispersed therein. A larger amount of light is reflected by inorganic oxide having a large refractive index and dispersed inside the synthetic resin, to cause a plurality of light emitting sections to emit bright light with a small number of light emitting elements. A light guiding sheet capable of making bright and uniform illumination and a movable contact body using the same are realized with a simple configuration.

6 Claims, 2 Drawing Sheets

LIGHT GUIDING SHEET AND MOVABLE CONTACT BODY USING THE SAME

TECHNICAL FIELD

The technical field relates to a light guiding sheet and a movable contact body using the same, which are used mainly in operation of a variety of electronic equipment.

BACKGROUND

In recent years, in an increasing number of variety of electronic equipment, particularly portable terminal equipment such as a cellular phone, in order to facilitate pressing of buttons and identification as well as operation of a display sheet and the like even in dark surroundings, a light emitting diode, an EL device or the like is made to emit light for illumination of an operational section. Also as a movable contact body and a switch for use in the equipment, ones easy to use and capable of making diverse illumination have been desired.

Such a conventional light guiding sheet and a movable contact body are described with reference to FIG. 3. It is to be noted that this drawing is represented by partially enlarging its size for the sake of facilitating understanding of its configuration.

FIG. 3 is a sectional view of a conventional switch. In FIG. 3, there is shown transmissive film-shaped base material 1. On the under surface of this base material 1, a plurality of light emitting sections 2 formed in a concavo-convex shape are provided, to form light guiding sheet 3.

There are also shown film-shaped base sheet 4 and substantially dome-shaped movable contact 5 made of a conductive metal sheet. A predetermined area of the outer periphery of base sheet 4 is attached to the under surface of light guiding sheet 3 with an adhesive (not shown), and the plurality of movable contacts 5 are attached to the under surface of base sheet 4 below light emitting sections 2, to constitute movable contact body 6.

Wiring substrate 7 has a plurality of wiring patterns (not shown) formed on its top and under surfaces. Provided on the top surface of wiring substrate 7 are a plurality of fixed contacts 8 each formed of central fixed contact 8A in a substantially circular shape and outer fixed contact 8B in a substantially horse hoof shape or a substantially ring shape to surround central fixed contact 8A.

Movable contact body 6 is attached to the top surface of wiring substrate 7. The outer periphery of each of movable contacts 5 in movable contact body 6 is placed on outer fixed contact 8B, and the center of the under surface of movable contact 5 is opposed to central fixed contact 8A with a predetermined spacing.

There are mounted a plurality of light emitting elements 9, such as light emitting diodes, on the top surface of wiring substrate 7 on a side of light guiding sheet 3 so as to be arranged, for example, with light emitting surfaces thereof being oriented toward the right end surface of base material 1.

Transmissive film-shaped display sheet 10 has light shielding section 10A formed on the under surface of the display sheet by printing or the like, and predetermined areas of light shielding section 10A are cut out in the shapes of a letter, a symbol or the like to form a plurality of display sections 10B. Display sections 10B are arranged above the plurality of light emitting sections 2 of light guiding sheet 3, to constitute a switch.

The switch as thus configured is mounted on an operational surface of electronic equipment, and the plurality of central fixed contacts 8A, outer fixed contacts 8B as well as the plurality of light emitting devices 9 are connected to an electronic circuit (not shown) of the equipment through the wiring patterns or the like.

In the above configuration, when a downward pressing operation is performed on predetermined display section 10B of display sheet 10, light guiding sheet 3 and base sheet 4 are bent to press the substantially dome-shaped central section of movable contact 5. When predetermined pressing force is applied, movable contact 5 is elastically reversed downward with a click feeling. By the center of the under surface of movable contact 5 coming into contact with central fixed contact 8A, central fixed contact 8A and outer fixed contact 8B come into the state of being electrically connected with each other though movable contact 5.

Further, when the pressing force applied to display sheet 10 is released, movable contact 5 is elastically reversed upward by elastic returning force. The center of the under surface of movable contact 5 leaves central fixed contact 8A, and central fixed contact 8A and outer fixed contact 8B come into the state of being electrically disconnected from each other.

In accordance with electrical connection and disconnection at fixed contact 8, switching of each function is performed in the equipment. Further, when power is supplied from the electronic circuit of the equipment to the plurality of light emitting devices 9, light emitting devices 9 emit light, and such light is introduced into light guiding sheet 3 from the right end surface and propagates left inside base material 1 while being reflected therein.

This light is diffused and reflected on the plurality of light emitting sections 2 on the under surface of base material 1, to illuminate from below display section 10B of display sheet 10. By illumination of the plurality of display sections 10B, display of a letter, a symbol and the like on display section 10B can be identified, so as to facilitate operation.

Consequently, the conventional switch is configured as follows. A pressing operation is performed on display sheet 10 to press the top surface of light guiding sheet 3 and make movable contact 5 elastically reversed, so as to electrically connect and disconnect at fixed contact 8. Further, light of light emitting devices 9 is introduced into light guiding sheet 3 from the end surface, to cause the plurality of light emitting sections 2 to emit light, so as to illuminate the plurality of display sections 10B of display sheet 10.

It is to be noted that, as related art document information relevant to the invention of this application, there is known, for example, Japanese Patent Unexamined Publication No. 2007-87749.

In above-mentioned conventional light guiding sheet 3 and movable contact body 6, a material for the plurality of light emitting sections 2 formed in a concavo-convex shape is the same as that for base material 1, and a light refractive index thereof is also the same as that of base material 1. It is difficult to cause the plurality of light emitting sections 2 to keep emitting light of sufficient brightness with a small number of light emitting devices 9. It is thus necessary to arrange a large number of light emitting devices 9 on the outer periphery of light guiding sheet 3 for bright and uniform illumination. This causes light guiding sheet 3 and movable contact body 6 to have complex configurations and to be expensive.

SUMMARY

A light guiding sheet is configured by forming a light emitting section in a concavo-convex shape to be provided on one side of a film-shaped base material, using a synthetic resin with inorganic oxide particles dispersed therein. A large amount of light can be reflected by inorganic oxide having a large refractive index and dispersed inside the synthetic resin, so as to cause the plurality of light emitting sections to emit bright light with a small number of light emitting elements. Therefore, a light guiding sheet capable of making bright and uniform illumination can be obtained with a simple configuration.

Further, a movable contact body is configured by mounting a substantially dome-shaped movable contact made of a conductive metal sheet in correspondence with a position below a light emitting section, formed of a synthetic resin with inorganic oxide particles dispersed therein, in a light guiding sheet. It is possible to realize, with a simple configuration, a movable contact body capable of brightly and uniformly illumination with a plurality of light emitting sections.

DESCRIPTION OF THE EXEMPLARY EMBODIMENT

Exemplary Embodiment

In the following, one embodiment of a light guiding sheet and movable contact body is described with reference to FIGS. 1 and 2.

It is to be noted that each of these drawings is represented by partially enlarging its size for the sake of facilitating understanding of its configuration. Further, portions having the same configurations as those described in the chapter of the background art are provided with the same symbols, and detailed descriptions thereof are simplified.

Figure 1:
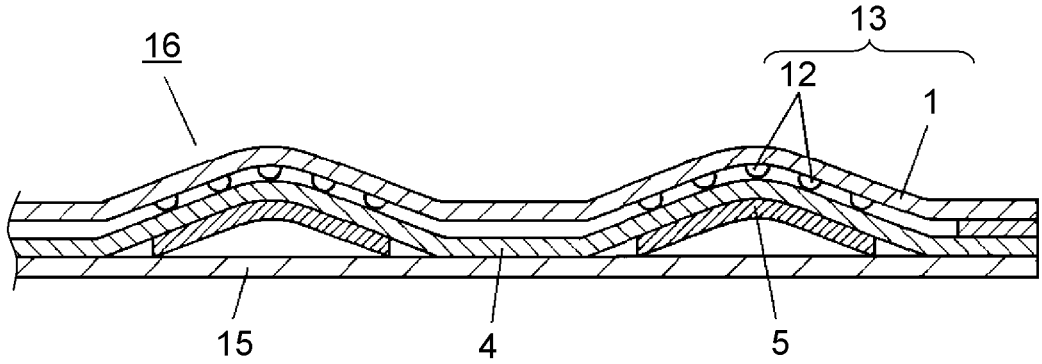
FIG. 1 is a sectional view of a movable contact body according to one embodiment.

FIG. 1 is a sectional view of a movable contact body according to one embodiment. In FIG. 1, transmissive base material 1 is in a film shape made of polyurethane, silicone, styrene, or the like, and has flexibility. The base material 1 has a refractive index of approximately 1.5. On the under surface of base material 1, there is provided a plurality of light emitting sections 12 formed in a concavo-convex shape by printing or the like.

Light emitting section 12 is formed of a transmissive synthetic resin, such as a polyester resin, an urethane resin, an acrylic resin or an epoxy resin, having a refractive index of approximately 1.5 to 1.6, in which inorganic oxide particles such as barium titanate, titanium oxide, or zinc oxide are dispersed, the particles being white, ivory-yellow or some other color and having a particle size of approximately 0.1 to 5 μm and a refractive index of approximately 1.8 to 2.8. Light emitting sections 12 and base material 1 constitute light guiding sheet 13.

Film-shaped base sheet 4 is made of polyethylene terephthalate or the like. Substantially dome-shaped movable contact 5 is made of a conductive metal sheet of a copper alloy, steel, or the like. Predetermined areas of the outer periphery of base sheet 4 are attached to the under surface of light guiding sheet 13 with an adhesive (not shown), and the plurality of movable contacts 5 are attached to the under surface of base sheet 4 below light emitting sections 12.

There is provided film-shaped separator 15 made of polyethylene terephthalate or the like. This separator 15 is attached so as to cover the entire under surface of base sheet 4. Movable contact body 16 is configured such that separator 15 prevents dust and the like from adhering to the under surface of movable contact 5 at the time of storage and carriage.

Figure 2:
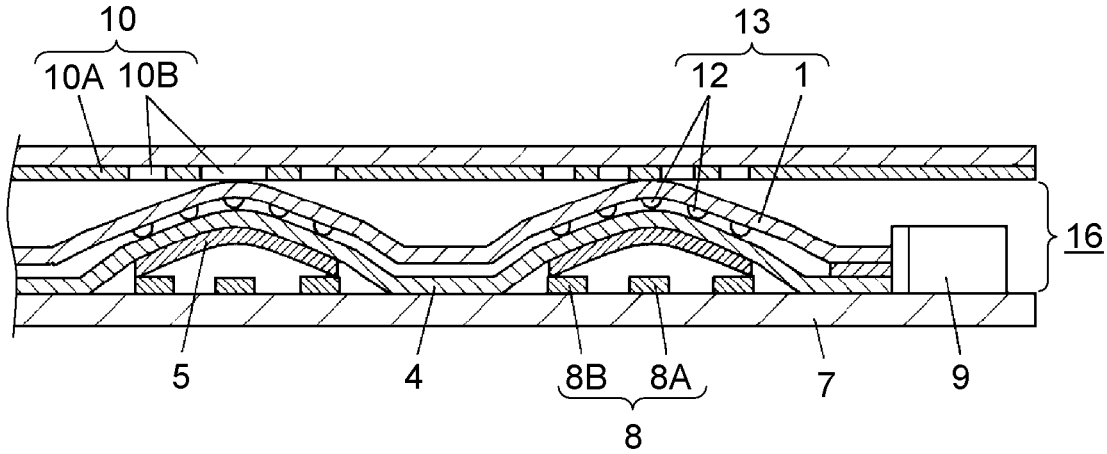
FIG. 2 is a sectional view of a switch according to one embodiment.
Figure 3:
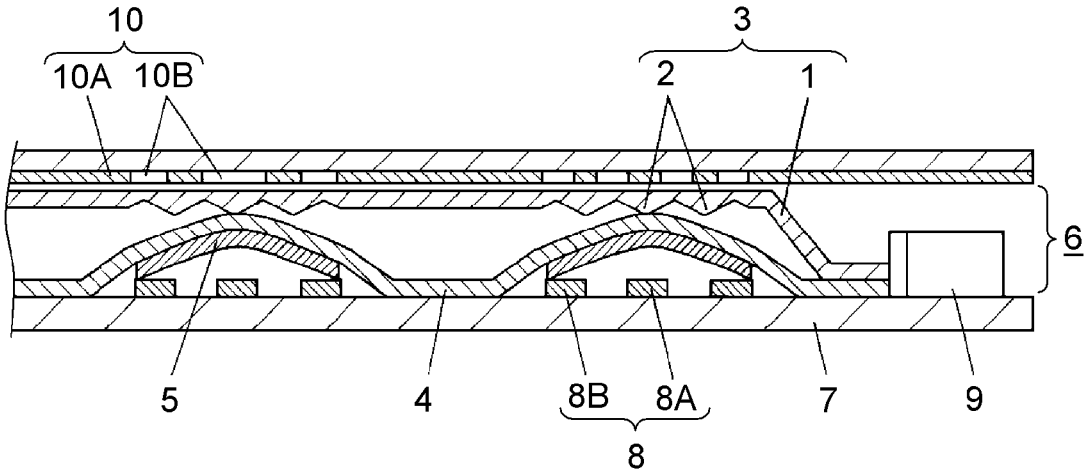
FIG. 3 PRIOR ART
FIG. 3 is a sectional view of a conventional switch.

FIG. 2 is a sectional view of a switch according to one embodiment. FIG. 2 shows a switch using movable contact body 16. In FIG. 2, wiring substrate 7 has a film shape made of polyethylene terephthalate, polycarbonate or the like, or has a plate shape made of paper phenol, glass-in epoxy or the like. A plurality of wiring patterns (not shown) are formed on one of or both of the top and under surfaces of wiring substrate 7. Provided on the top surface of wiring substrate 7 are a plurality of fixed contacts 8 made of copper, carbon or the like, and each formed of central fixed contact 8A in a substantially circular shape and outer fixed contact 8B in a substantially horse hoof shape or a substantially ring shape so as to surround central fixed contact 8A.

Movable contact body 16 with separator 15 peeled off is attached to the top surface of wiring substrate 7. The outer periphery of each of movable contacts 5 in movable contact body 16 is placed on outer fixed contact 8B, and the center of the under surface of movable contact 5 is opposed to central fixed contact 8A with a predetermined spacing.

A plurality of light emitting elements 9, such as light emitting diodes, are mounted on the top surface of wiring substrate 7 on a side of light guiding sheet 13, for example, so as to be arranged on the right end surface of base material 1 with light emitting surfaces being oriented toward left.

Transmissive film-shaped display sheet 10 has light shielding section 10A, formed on the under surface of the display sheet by printing or the like, and predetermined areas of light shielding section 10A are cut out in the shape of a letter, a symbol and the like, to form a plurality of display sections 10B. Display sections 10B are arranged above the plurality of light emitting sections 12 of light guiding sheet 13, to constitute a switch.

The switch as thus configured is mounted on an operational surface of electronic equipment, and the plurality of central fixed contacts 8A and outer fixed contacts 8B as well as the plurality of light emitting devices 9 are connected to an electronic circuit (not shown) of the equipment through wiring patterns or the like.

In the above configuration, when a downward pressing operation is performed on predetermined display section 10B of display sheet 10, light guiding sheet 13 and base sheet 4 are bent to press the substantially dome-shaped central section of movable contact 5. When predetermined pressing force is applied, movable contact 5 is elastically reversed downward with a click feeling. By the center of the under surface of movable contact 5 coming into contact with central fixed contact 8A, central fixed contact 8A and outer fixed contact 8B come into the state of being electrically connected with each other though movable contact 5.

Further, when the pressing force applied to display sheet 10 is released, movable contact 5 is elastically reversed upward by elastic returning force. The center of the under surface of movable contact 5 leaves central fixed contact 8A, and central fixed contact 8A and outer fixed contact 8B come into the state of being electrically disconnected from each other.

In accordance with electrical connection and disconnection at fixed contact 8, switching of each function of the equipment is performed. When power is supplied from the electronic circuit of the equipment to the plurality of light emitting devices 9, light emitting devices 9 emit light, and this light is introduced into light guiding sheet 13 from its right end surface, and propagates left inside base material 1 while being reflected therein.

This light is diffused and reflected in the plurality of light emitting sections 12 on the under surface of base material 1, and illuminates from below display sections 10B of display sheet 10. By illumination of the plurality of display sections 10B, display of a letter, a symbol and the like of display section 10B can be identified even in dark surroundings, so as to facilitate operation.

Consequently, the switch is configured as follows. A pressing operation is performed on display sheet 10 to press the top surface of light guiding sheet 13 and cause movable contact 5 to be elastically reversed, so as to electrically connect and disconnect at fixed contact 8. Further, light of light emitting devices 9 is introduced into light guiding sheet 13 from its end surface, to cause the plurality of light emitting sections 12 to emit light, so as to illuminate the plurality of display sections 10B of display sheet 10.

As described above, in concavo-convex light emitting section 12 formed on the under surface of base material 1, inorganic oxide particles are dispersed, the particles being white, milky white or some other color and having a larger refractive index than that of base material 1. Therefore, when the light of light emitting devices 9 having been introduced into base material 1 enters the plurality of light emitting sections 12, the light is diffused and reflected by the inorganic oxide particles and light emitting sections 12 emit bright light.

As the synthetic resin for light emitting section 12, it is preferable to use one having a light refractive index equivalent to or slightly larger than that of base material 1. This is because such a resin facilitates incidence of light having proceeded inside base material 1 into light emitting section 12, to increase the degree of diffusion and reflection by the inorganic oxide particles. For example, in a case of using polyurethane (light refractive index of the order of 1.50 to 1.52) for base material 1, light emitting section 12 may be configured such that an urethane acrylate resin (light refractive index of the order of 1.50 to 1.55) is selected as the synthetic resin with white barium titanate particles (light refractive index of approximately 2.4) dispersed therein.

As thus described, dispersing inorganic oxide particles having a larger refractive index than that of base material 1 inside light emitting section 12 can eliminate the need for a large number of light emitting devices 9 and cause the plurality of light emitting sections 12 to emit bright light with a small number of light emitting devices 9. Further, it is possible that bright and uniform illumination can be made with a simple configuration.

It is to be noted that, even when silica having a refractive index of approximately 1.5, or the like, is dispersed, light emitting section 12 can be formed. However, as described above, with the use of inorganic oxide particles having a larger refractive index than the refractive index of approximately 1.5 of base material 1, such as titanium oxide having a refractive index of approximately 2.7, barium titanate having a refractive index of approximately 2.4, or zinc oxide having a refractive index of approximately 2.0, it is possible to reflect a larger amount of light of light emitting devices 9, so that the plurality of light emitting sections 12 can make more uniform and bright illumination.

Setting the particle size of the inorganic oxide particles dispersed inside light emitting section 12 to approximately 0.1 to 5 μm allows reflection of a large amount of light of light emitting devices 9, and further allows uniform dispersion of the inorganic oxide particles inside the synthetic resin. More preferably, setting to a particle size close to a 0.4 to 0.8 μm wavelength of visible light, or to a particle size of approximately 0.4 to 1.5 μm which is slightly larger than the above wavelength, allows more favorable reflection of light.

Further, setting the amount of the inorganic oxide particles dispersed inside the synthetic resin to approximately 5 to 70 wt %, more preferably to 10 to 40 wt %, with respect to the synthetic resin allows favorable reflection and uniform formation of light emitting sections 12 by printing or the like.

In this manner, a light guiding sheet 13 includes concavo-convex light emitting sections 12, provided on the under surface of base material 1 formed of a synthetic resin with inorganic oxide dispersed therein. A larger amount of light can be reflected by inorganic oxide having a large refractive index and dispersed inside the synthetic resin, so as to cause the plurality of light emitting sections 12 to emit bright light with a small number of light emitting devices 9. It is thereby possible to obtain light guiding sheet 13 capable of causing bright and uniform illumination, and movable contact body 16 using this light guiding sheet, with a simple configuration.

It should be noted that the configuration has been described in the above description where the plurality of light emitting sections 12 are formed by printing on the under surface of base material 1 of light guiding sheet 13 above movable contacts 5. However, a light guiding sheet can have a configuration where light emitting sections 12 are formed not on the under surface but on the top surface of base material 1. Further, concavo-convex light emitting sections 12 can also be formed by a variety of methods other than printing, such as ink-jetting or attachment.

Further, in the above description, the configuration has been described where base sheet 4 with the plurality of movable contacts 5 attached to it's under surface is attached to the under surface of light guiding sheet 13. However, such a configuration can also be formed that base sheet 4 is eliminated and the plurality of movable contacts 5 are attached directly to the under surfaces of light emitting sections 12 of light guiding sheet 13. It is thereby possible to reduce the number of constitutional components as a whole, so as to make the movable contact body simpler and cost less.

What is claimed is:

1. A light guiding sheet comprising:

a transmissive film-shaped base material; and a concavo-convex light emitting section formed on at least one side of the base material, wherein the light emitting section is formed of a synthetic resin with inorganic oxide particles dispersed therein, and a refractive index of the base material is from 1.50 to 1.52 and a refractive index of the synthetic resin is from 1.50 to 1.55.

2. A movable contact body comprising:

the light guiding sheet of claim 1; and a substantially dome-shaped movable contact made of a conductive metal sheet and mounted in correspondence with a position below the light emitting section.

3. A movable contact body comprising:

a transmissive film-shaped base material;

a concavo-convex light emitting section formed on at least one side of the base material; and a substantially dome-shaped movable contact made of a conductive metal sheet and mounted in correspondence with a position below the light emitting section, wherein the light emitting section is formed of a synthetic resin with inorganic oxide particles dispersed therein, and a refractive index of the base material is from 1.50 to 1.52 and a refractive index of the synthetic resin is from 1.50 to 1.55.

4. The movable contact body according to claim 3, wherein a particle size of the inorganic oxide particles is from 0.1 to 5 μm.

5. The movable contact body according to claim 3, wherein a refractive index of the inorganic oxide particles is from 1.8 to 2.8.

6. The movable contact body of claim 3, wherein the inorganic oxide particles comprise one of titanium oxide, barium titanate, and zinc oxide.

* * * * *